US012110774B2

(12) United States Patent
Hunter

(10) Patent No.: US 12,110,774 B2
(45) Date of Patent: Oct. 8, 2024

(54) ARTIFICIAL POROSITY-PRESSURE ADJUSTABLE FORMATION FLUID-GAS CONTROL SYSTEM AND METHOD

(71) Applicant: Clifford Wayne Hunter, The Woodlands, TX (US)

(72) Inventor: Clifford Wayne Hunter, The Woodlands, TX (US)

( * ) Notice: Subject to any disclaimer, the term of this patent is extended or adjusted under 35 U.S.C. 154(b) by 140 days.

(21) Appl. No.: 16/110,099

(22) Filed: Aug. 23, 2018

(65) Prior Publication Data

US 2019/0063204 A1 Feb. 28, 2019

Related U.S. Application Data

(60) Provisional application No. 62/549,656, filed on Aug. 24, 2017.

(51) Int. Cl.

| | |
|---|---|
| ***E21B 43/38*** | (2006.01) |
| ***E21B 43/08*** | (2006.01) |
| *E21B 33/12* | (2006.01) |

(52) U.S. Cl.
CPC ..... *E21B 43/38* (2013.01); *E21B 43/088* (2013.01); *E21B 33/12* (2013.01)

(58) Field of Classification Search
CPC ..... E21B 33/12; E21B 43/088; E21B 43/38
See application file for complete search history.

(56) References Cited

U.S. PATENT DOCUMENTS

| | | | | |
|---|---|---|---|---|
| 3,080,919 A * | 3/1963 | Harlan | E21B 33/12 | 166/261 |
| 4,167,972 A * | 9/1979 | Sears | B01D 29/15 | 166/233 |
| 2011/0042096 A1* | 2/2011 | Nutley | E21B 43/084 | 166/369 |
| 2011/0114339 A1* | 5/2011 | Adamson | E21B 7/20 | 166/386 |
| 2013/0000890 A1* | 1/2013 | Olenick | E21B 43/088 | 166/233 |
| 2014/0048257 A1* | 2/2014 | Hunter | E21B 33/12 | 166/265 |

FOREIGN PATENT DOCUMENTS

| | | | | |
|---|---|---|---|---|
| GB | 1138457 A * | 1/1969 | E21D 11/381 | |

* cited by examiner

*Primary Examiner* — Caroline N Butcher
(74) *Attorney, Agent, or Firm* — Clark Hill PLC; David Gorski

(57) ABSTRACT

An oil and gas downhole device is disclosed wherein the device separates the oil and gas from undesired water, which returns to the formation. The device includes a plurality of channels filled with elements fit tightly to a gas tight seal at atmospheric pressure with interstitial spaces. Under pressure the device allows oil and gas to pass but not water within its operating range of pressures. Also included is a method for using the device.

14 Claims, 10 Drawing Sheets

ARTIFICIAL POROSITY-PRESSURE ADJUSTABLE FORMATION FLUID-GAS CONTROL SYSTEM AND METHOD

BACKGROUND OF THE DISCLOSURE

1. Field of the Disclosure

This disclosure relates to apparatuses and methods for separating water from oil and gas in a hydrocarbon production well.

2. Description of the Related Art

In the production of wells, the effluent of the well may contain desirable and undesirable materials. An example of this is oil and gas wells, where oil and/or gas are produced alongside water. The oil and/or gas are desirable and the water is not.

A shortcoming of existing production wells is that significant quantities of water are brought to the surface and must be hauled away in trucks or barges. The release of this water to the surface can reduce well pressure and release contaminants on the surface.

Another shortcoming of some existing production wells is the production of minerals that must be extracted at the surface.

What is needed is a production system that suppresses the production of minerals and water to the surface.

BRIEF SUMMARY OF THE DISCLOSURE

In aspects, the present disclosure is related to systems, apparatuses, and methods for hydrocarbon production, specifically for reduction of produced water from a well.

One embodiment according to the present disclosure includes an oil-field apparatus comprising: a cylindrical member with a central bore and a plurality of channels cut into an outer surface of the cylindrical member; a plurality of openings at the bottom of each of the plurality of channels, where each of the openings extends to the central bore; a plurality of elements disposed in each of the plurality of channels, wherein each of the plurality of elements has a length substantially the same as a length of its respective channel, and wherein the plurality of elements are arranged in at least two layers and fitted together to form a gas tight seal at normal atmospheric pressure; and a fastening means at each of each of the plurality of elements to attached the elements to the cylindrical member. The apparatus may also include an end cap disposed on one end of the cylindrical member to close the central bore. The apparatus may also include a wire screen wrapped around a circumference of the cylindrical member and covering plurality of channels. Elements in each channel maybe uniform or non-uniform.

Another embodiment according to the present disclosure includes a system for producing oil and/or gas from in a wellbore in a formation, comprising: a well tubing string disposed in the wellbore; an annular sealing device disposed in the wellbore and attached to the well tubing string; an apparatus disposed on the well tubing string and below the annular sealing device the apparatus comprising: a cylindrical member with a central bore and a plurality of channels cut into an outer surface of the cylindrical member; a plurality of openings at the bottom of each of the plurality of channels, where each of the openings extends to the central bore; a plurality of elements disposed in each of the plurality of channels, wherein each of the plurality of elements has a length substantially the same as a length of its respective channel, and wherein the plurality of elements are arranged in at least two layers and fitted together to form a gas tight seal at normal atmospheric pressure; and a fastening means at each of each of the plurality of elements to attached the elements to the cylindrical member. The system may include an end cap disposed on a bottom end of the cylindrical member. The system may include a second apparatus disposed below and coupled in series with the apparatus; and an end cap disposed on a bottom of the second apparatus instead of the first apparatus.

Another embodiment according to the present disclosure includes a method for producing gas and/or oil from a wellbore in a formation, the method comprising: flowing gas and/or oil from the wellbore through an apparatus connected to a tubing string disposed in the wellbore in an operating pressure range of the apparatus, where the apparatus comprises: a cylindrical member with a central bore and a plurality of channels cut into an outer surface of the cylindrical member; a plurality of openings at the bottom of each of the plurality of channels, where each of the openings extends to the central bore; a plurality of elements disposed in each of the plurality of channels, wherein each of the plurality of elements has a length substantially the same as a length of its respective channel, and wherein the plurality of elements are arranged in at least two layers and fitted together to form a gas tight seal at normal atmospheric pressure; and a fastening means at each of each of the plurality of elements to attached the elements to the cylindrical member; and rejecting the flow of water through the apparatus to the well tubing string. The method may also include estimating an operating pressure range of the apparatus. The method may also include selecting the wellbore based on the operating pressure range of the apparatus. The method may also include installing the apparatus in the wellbore. The method may also include injecting gas and/or oil into the wellbore prior to flowing gas and/or oil to the surface. The injecting of gas may force some fluids in the wellbore back into the formation.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a further understanding of the nature and objects of the present disclosure, reference should be made to the following drawings in which like parts are given like reference numerals and wherein.

Figure 1:
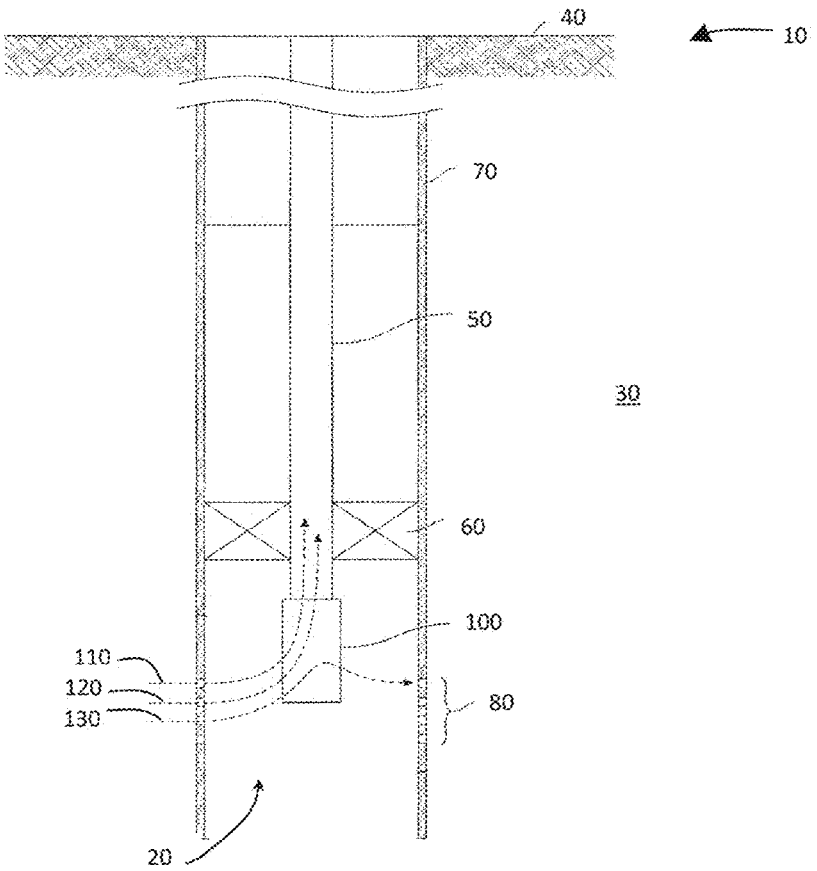
FIG. 1 is a diagram of one embodiment of a drilling system with an artificial porosity apparatus in a wellbore according to the disclosure.

While the inventions disclosed herein are susceptible to various modifications and alternative forms, only a few specific embodiments are shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art, and to enable such persons to make and use one or more of the inventive concepts.

DESCRIPTION OF THE DISCLOSURE

FIG. 1 shows a diagram of a downhole production system 10 having an artificial porosity apparatus 100 disposed in a wellbore 20 in a formation 30 and configured to allow from oil and gas to flow to the surface 40 while reducing the amount of water flowing to the surface 40. The system may include a well tubing string 50 disposed in the wellbore 20 and connected to an annular sealing device 60 disposed between the well tubing string 50 and a casing 70 in the wellbore 40. The annular sealing device 60 may include an isolation packer and is configured to provide pressure isolation as would be understood by a person of ordinary skill in the art. The well tubing string 50 may include a production tubular suitable for downhole conditions in an oilfield environment as would be understood by a person of ordinary skill in the art. The apparatus 100 may be disposed along the well tubing string 50 in the wellbore 20 below the annular sealing device 60. The apparatus 100 is configured to allow the passage of oil 120 and gas 130 but to reject or prevent the passage of water 140 from the wellbore 20 into the well tubing string 50. Under certain conditions, the oil 110, the gas 120, and the water 130 may flow from the formation 30 through perforations 80 in the casing 70 into the well bore 20 below the annular sealing device 60. From the wellbore 20, the oil 110 and gas 120 may flow through the apparatus 100 and into the well tubing string 50 and up to the surface 40. Some or all of the water 130 associated with the oil 110 and the gas 120 may be rejected by apparatus 100 and remain in the wellbore 20 or flow back into the formation 30.

A condition that affects whether fluid will pass into the apparatus is differential pressure between the pressure in the wellbore 20 and the pressure inside well tubing string 50, which is the pressure across the apparatus 100. Under low pressures, there may no flow of fluid through the apparatus 100. Under intermediate pressures, the gas 120 or the oil 110 and the gas 120 may flow through the apparatus 100 and into the well tubing string 50 but not the water 130. Within the intermediate pressure range, there may be a lower range where only the gas 120 may flow through the apparatus 100 and an upper range where the gas 120 and the oil 110 may flow through the apparatus 100. At high pressure, the oil 110, the gas 120, and the water 130 may flow through the apparatus 100 and into the well tubing string 50. Thus, the placement of the apparatus 100 in the wellbore 20 such that a suitable differential pressure across the apparatus 100 is present for the operating pressure characteristics of the apparatus 100 is critical to operations that require the flow of either only gas, or oil and gas, but not water. Generally, the operating pressure for the apparatus 100 is the intermediate pressure range when the apparatus 100 is being configured to reduce the production of water at the surface 40. The definitions for low, intermediate, and high pressures for a particular apparatus 100 are determined by the structural design of the apparatus 100. The availability of said pressures is determined by characteristics of the wellbore 20 and the formation 30, as would be understood by a person of ordinary skill in the art. For example, a particular embodiment of the apparatus 100 may have a low pressure range of 0 to 100 psig (0 to 690 kPa), an intermediate pressure range of 100 to 800 psig (690 kPa to 5.52 MPa), and a high pressure range of above 800 psig (5.52 MPa). Within the intermediate range, only gas may flow between 100 and 200 psig (690 kPa to 1.38 MPa), while gas and oil may flow in the range of 200 to 800 psig (1.38 MPa to 5.52 MPa). The above pressure ranges are exemplary and illustrative only, as the apparatus 100 may be configured to operate over different pressure ranges by adjusting its structure as discussed below.

Figure 2:
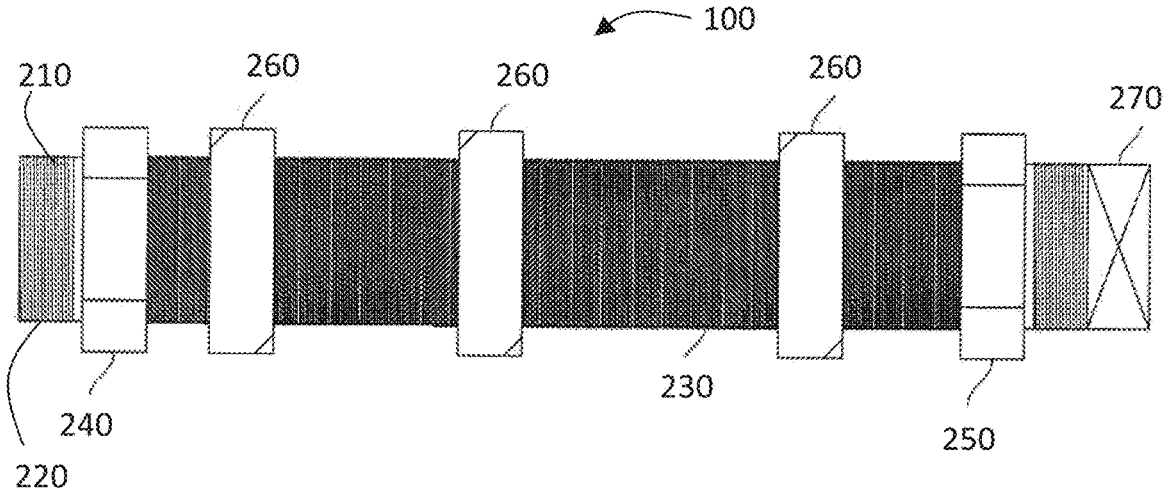
FIG. 2 is a diagram of a side view of the apparatus according to one embodiment of the disclosure.
Figure 3:
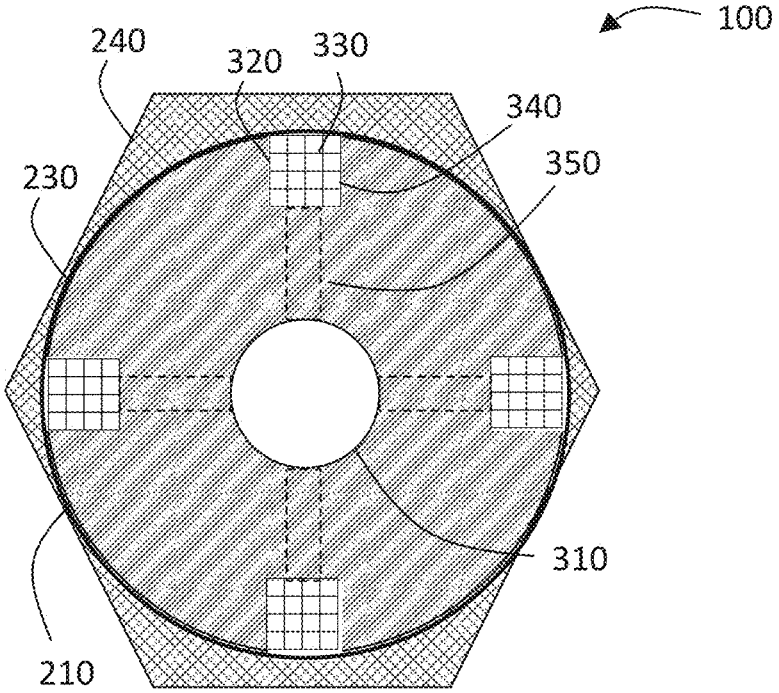
FIG. 3 is a diagram of an end cross-sectional view of the apparatus according to one embodiment of the disclosure.

FIG. 2 shows a side-view of an embodiment of the apparatus 100, which includes a cylindrical member 210 with a central bore 310 (see FIG. 3). The cylindrical member 210 may be made of any material selected as suitable for wellbore conditions in an oil well. Suitable materials include steel and stainless steel, as well as, any materials suitably structurally and chemically resistant to the downhole environment as would be understood to one of ordinary skill in the art. In some embodiments, the cylindrical member 210 may include an outer layer resistant (not shown) to downhole conditions and a less resistant interior (not shown) that does not come in direct contact with the fluids in the wellbore 20. The cylindrical member 210 may be a cylindrical metal bar or a tubular with a suitably thick wall for handling wellbore pressures and other conditions. In one embodiment, the cylindrical member 210 is a 28 inch long (71 centimeter) and 3.5 inch (8.9 centimeter) diameter stainless steel cylinder where the central bore 310 is 1 inch (2.5 centimeters). As would be understood by person of ordinary skill in the art, the dimensions of the cylindrical member 210 and the central bore 310 may varied based on the flow characteristics of the well, the dimensions of the well tubing string 50, and the preferences of the operator. The ends of the cylindrical member 210 may have threads 220 that serve as attachment points between the apparatus 100 an the well tubing string 50 or other downhole tools as would be understood by a person of ordinary skill in the art. In one embodiment, the threads 220 extend for 2.5 inches (6.4 centimeters) on each of the ends of the cylindrical member 210. In some embodiments, only one end may have the threads 220. The apparatus 100 also includes a wire screen 230 wrapped around the circumference of the cylindrical member 210. The wire screen 230 may be configured to keep sand and other particulate matter from entering the apparatus 100. In one embodiment, the wire screen 230 includes a 0.125 inch diameter (3.18 millimeter) stainless steel wire wrapped around the unthreaded portion of the cylindrical member 210 with a gap between wire windings of between 0.004 inches and 0.079 inches (100 micrometers and 2000 micrometers). The gas between windings may be customized based on the typical particle size encountered in a particular well as would be understood by a person of ordinary skill in the art. The wire screen 230 may be welded at each end to the cylindrical member 210. An upper nut 240 and a lower nut 250 may be threaded on the ends for the cylindrical member 210 to hold the wire screen 230 in place longitudinally. The wire screen 230 may be radially secured to the cylindrical member 210 by one or more rings 260. The rings 260 may slideable along the longitudinal axis of the cylindrical member 210 or formed by pairs of hemispherical sections that are coupled together, such as by welding. In some embodiments, the rings 260 may include compression washers. The upper nut 240, and the lower nut 250, and the rings 260 also serve to protect the wire screen 230 from damage during insertion, removal, and operation in the wellbore 20. The apparatus 100 may include an optional end cap 270. The end cap 270 seals the central bore 310 to prevent fluids from entering the lower end of the cylindrical member 210. If multiple apparatuses 100 are being used in series, only the lowest of them will have the end cap 270. In some embodiments, the central bore 310 may be incomplete (not shown) so that the central bore 310 does not penetrate both ends of the cylindrical member 210.

FIG. 3 shows an end cross-section of the apparatus 100. The cylindrical member 210 is shown with the central bore 310. A plurality of channels 320 are formed in the surface of the cylindrical member 210. The channels 320 may be uniform or non-uniform in shape and size. Each of the channels 320 includes a plurality of flow control members such as bars 330 or rods 430 (see FIG. 4B) arranged in layers 340. Each of the bars 330 is dimensioned such that each layer 340 spans the width of one of the channels 320 using a whole number of bars 330. The bars 330 may be uniform or non-uniform in width and depth. While the channel 320 is shown with substantially equal width and depth, this is illustrative and exemplary only. In practice, the channels 320 may be deeper than they are wide or wider than they are deep. While there are four channels 320 shown, this is illustrative and exemplary as well, as any number of channels 320 may be used. The channels 320 may be uniformly or non-uniformly spaced along the circumference of the cylindrical member 320. The bars 330 may be solid or hollow. The size, structure, and material of the bars 330 may be selected based on the well pressure conditions of the well where the apparatus 100 is installed. Fluid communication between the channels 320 and the central bore 310 is provided for through multiple openings 350 between each of the channels 320 and the central bore 310. In one exemplary embodiment, the channel 320 may be about 0.50 inches by 0.50 inches (1.27 centimeters by 1.27 centimeters) width and extend the length of the cylindrical member 310 between the first nut 240 and the second nut 250. In one embodiment, where the cylindrical member 310 is 28 inches (71 centimeters) with 2.5 inch (6.4 centimeter) threaded ends, the channels 320 may be up to 23 inches (58.2 centimeters) in length, though the channel length may be reduced to modify the amount of flow into the apparatus 100.

Figure 4A:
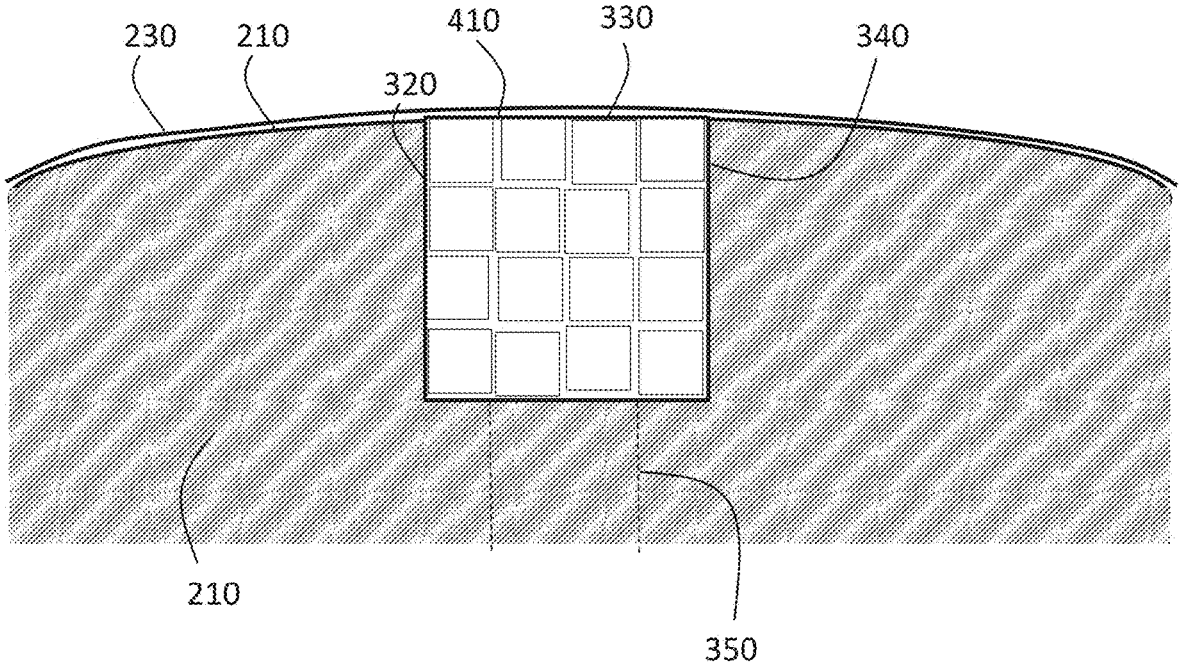
FIG. 4A is a diagram of a close up end view of the channel with bars in the apparatus of FIG. 3.

FIG. 4A shows a close up of the end view of one of the channels 320 in the surface of the cylindrical member 210 from FIG. 3, The bars 330 may be spaced uniformly or non-uniformly within the channel 320. The bars 330 are formed with tight tolerances such that they fit together to form a gas tight seal at normal atmospheric pressure, but have some interstitial spaces 410 in between while under an operating pressure. In some embodiments, the bars 330 in a layer 340 may be dimensioned by dividing the width of the channel 320 by a whole number of bars 330 of substantially similar size; however, the bars 330 may be non-uniform in size so long as they are arranged to fit the width of the channel 320 and the spacing between the bars 330 is air tight at low pressures (on the order of 100 psig (690 kPa) or less). In some embodiments, the bars 330 may be formed to a tolerance of about 0.001 to 0.003 of an inch (about 25-75 micrometers), and the bars 330 are fitted together to be air tight in the channel 320 at normal atmospheric pressure. For example, if the channel 320 is 0.50 inches (12.7 millimeters) by 0.50 inches (12.7 millimeters) and each layer 340 has four bars that are uniform and square, then each bar 330 would be about 0.125 inches by 0.125 inches (3.18 millimeters by 3.18 millimeters) and have a length that is about the length of the channel 320. In an embodiment, with a channel length of 23 inches (58.2 centimeters) each bar would have a nominal length of about 23 inches (58.2 centimeters) with sufficient space on each end for a fastening means to secure the bar 330 to the cylindrical member 210. Interstitial spaces 410 may form between the bars 330 when the bars 330 are exposed to differential pressures between the wellbore 20 and the central bore 310, and the interstitial spaces 410 allow fluid from the wellbore 20 (usually a combination of water, oil and gas) to flow from the wellbore 20 into the central bore 310 through the channels 320. In some embodiments, the material properties of the flow control elements may impact water rejection by the apparatus 100, as some materials are hydrophilic and may impair the movement of water molecules through the matrix of flow control elements while allowing the passage of gas and oil under intermediate pressure conditions.

The number and size of the interstitial spaces 410 impact the flow rate and the water reduction of the apparatus 100. In some embodiments, the bars 330 may vary in width and depth so long as the bars 330 are dimensioned to fill the channel 320 and maintain the tight fitting layers 340, such that gas, oil, and water cannot flow into the apparatus 100 at low pressures (under about 100 psig (690 kPa)). Increasing the number of bars 330 in a layer 340 may increase flow rate of the apparatus 100, but may require thinning of the bars 330 that expose them to a risk of deformation under the differential pressure. Reducing the number of bars 330 results in lower flow and less deformation risk, but may increase the risk of an increase quantity of produced water. Similarly, increasing the number of layers 340 in a channel 320 may reduce the flow rate through the channel at the same pressure; however, reducing the number of layers 340 may increase the flow rate at the risk of an increase in the quantity of produced water. The selection of the dimensions of the flow control elements, whether bars 330 or rods 430, the number of layers 340 and the number of flow control elements per layer 340 may be adjusted to achieve the desired rate of flow for a specific set of well characteristics as would be understood by a person of ordinary skill in the art with the benefit of this disclosure. The flow of fluid is also influenced by the size and/or the shape of the openings 350, which provide back pressure to reduce stress on the bars 330 due the differential pressure across the bars 330. In some embodiments, the openings 350 may be dimensioned to have a diameter (if a circular), side length (if square), or a long dimension (if X-shaped, a cross, or a rectangular) of about one-eighth the width of the channel 320. The size and number of the openings 350 in each channel 320 may be varied to adjust the amount of flow into the central bore 310 and/or the stress on the flow control elements as would be understood by a person of ordinary skill in the art.

Figure 4B:
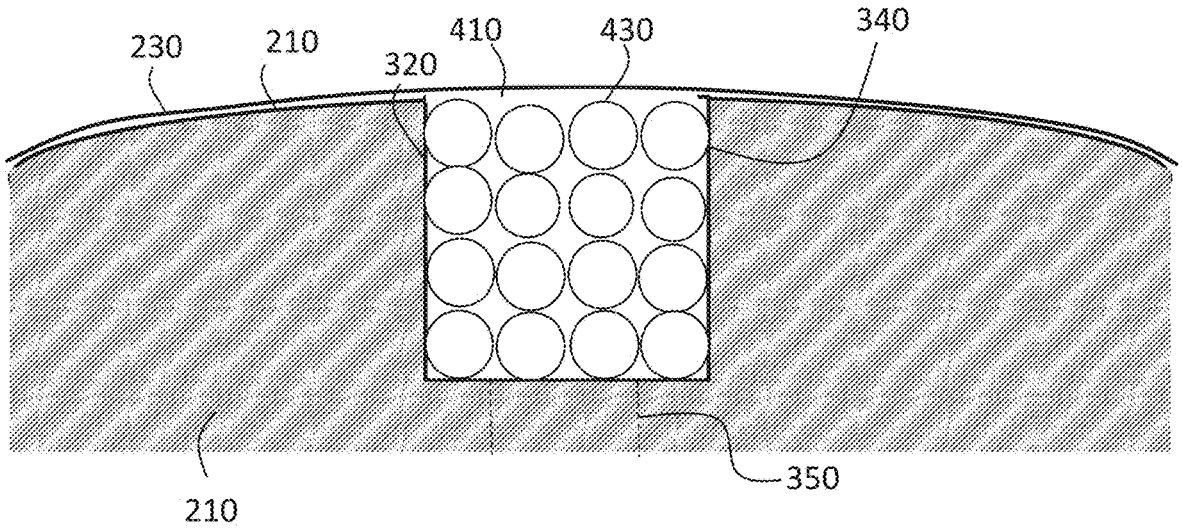
FIG. 4B is a diagram of a close up end view of the channel with rods in the apparatus of FIG. 3.

FIG. 4B shows a close up of the end view of one of the channels 320 in the surface of the cylindrical member 210 with flow control elements that are rods 430 instead of bars 330. Similar to FIG. 4A, the rods 430 are sized and arranged to form layers 340 such that a whole number of rods 430 spans the width of the channel 320. In some embodiments, the rods 430 may be solid, tubular, or a combination thereof. The rods 430 maybe fitted together to be air tight at low pressures (on the order of 100 psig (690 kPa) or less). The number of rods 430 per layer 340 and/or the number of layers 340 per channel 320 may be adjusted to modify the amount of flow into the central bore 310 at a given pressure as disclosed with regard to FIG. 4A.

Figure 4C:
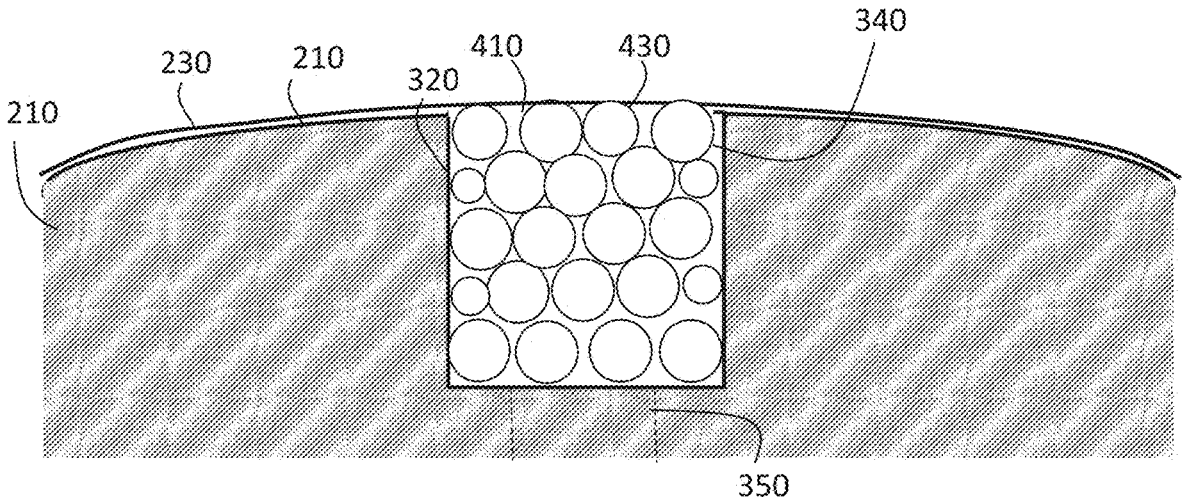
FIG. 4C is a diagram of a close up end view of the channel with rods of differing diameters in the apparatus of FIG. 3.

FIG. 4C shows a close up of the end view of one of the channels 320 in the surface of the cylindrical member 210 with rods 430 of differing diameters. The rods 430 are sized to form layers 340 such that a whole number of rods 430 spans the width of the channel 320. In some embodiments, the rods 430 may be arranged so that the layer 340 is staggered rather than flat. In some embodiments, the rods 430 may be solid, tubular, or a combination thereof. Again, the rods 430 are fitted together to form an air tight barrier between the outside of the channel 320 and the openings 350 at low pressures (on the order of 100 psig (690 kPa) or less). Similar to the disclosure regarding FIGS. 4A and 4B, the flow into the central bore 310 through the channels 320 may be modified by adjusting the number of rods 430 per layer 340 and/or the number of layers 340 in the channel 320.

Figure 5:
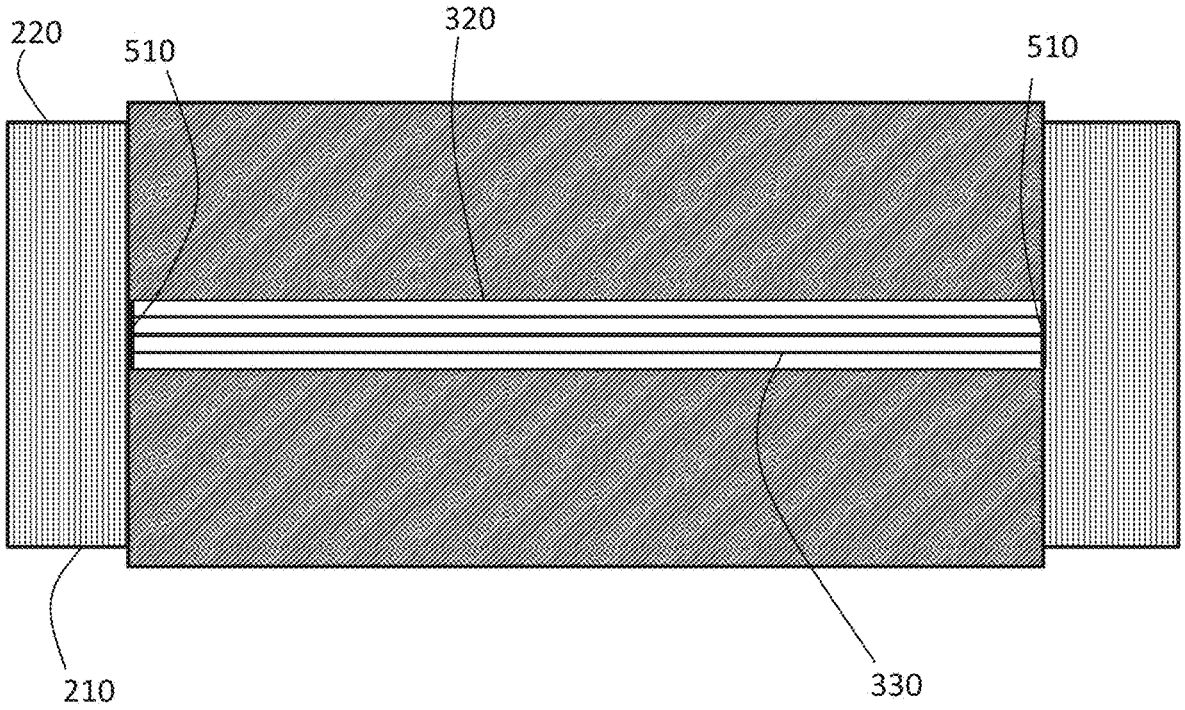
FIG. 5 is a diagram of a top view of the apparatus without the wire screen or rings according to the disclosure.

FIG. 5 shows a top view of the apparatus 100 without the wire screen 230, the upper nut 240, the lower nut 250, and the rings 260. At the ends of the channel 320, a fastening means 510 is shown to attach the ends of the bars 330 to the cylindrical member 210. The fastening means 510 may be any suitable attachment that prevents the bars 330 (or rods 430) from begin detached from the cylindrical member 210 during operations in the wellbore 20 and is not deteriorated by wellbore conditions. Exemplary fastening means 510 may include welds, clips, screws, and compression fitting.

Figure 6:
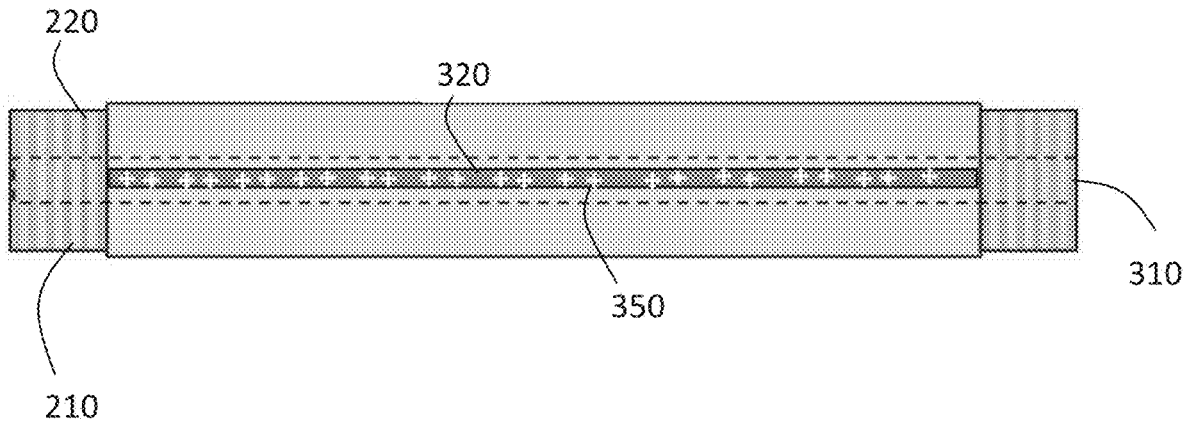
FIG. 6 is a diagram of an interior view of the apparatus of FIG. 3 without the outer screen or rings.

FIG. 6 shows a top view of the apparatus 100 with the bars 330 removed so that the openings 350 may be seen. The plurality of openings 350 allow passage of oil and gas from the wellbore 20 to reach the central bore 310 for movement to the surface 40. The openings 350 may be formed in one or more shapes. The shapes may include, but are not limited to, cross-shaped, X-shaped, circular, rectangular or square. As discussed regarding FIG. 4A, the dimensions of and number of openings 350 may be varied based on desired pressure and flow characteristics of the channel 320 with the flow control elements in place. In some embodiments, the long dimension of the opening may be about 0.063 inches (1.6 millimeters) when the width of the channel 320 is about 0.500 inches (12.7 millimeters).

Figure 7:
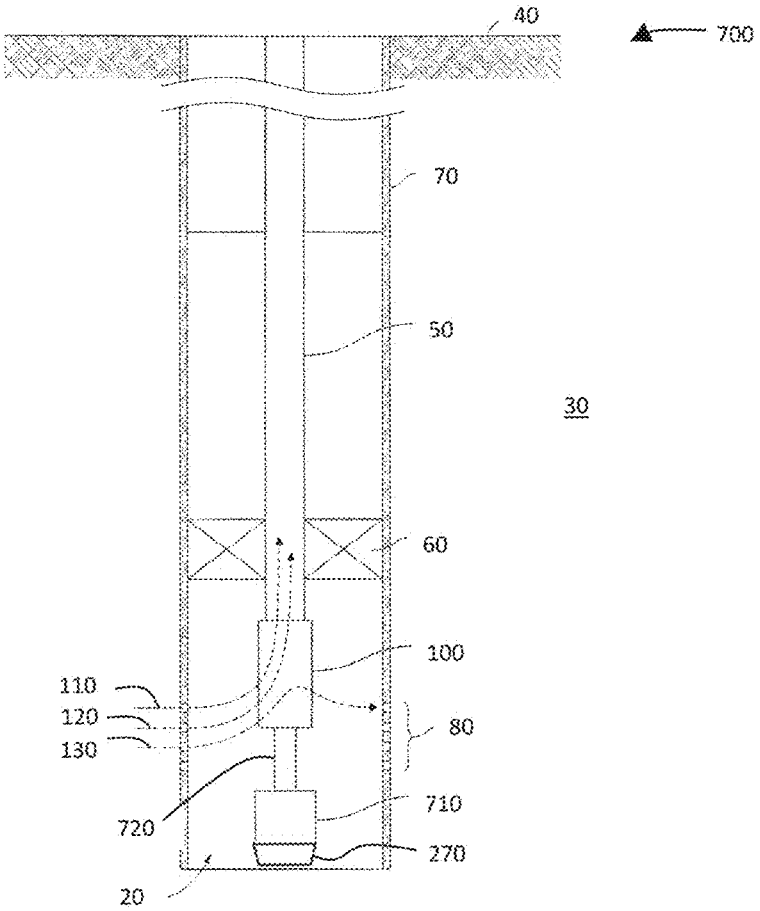
FIG. 7 is a diagram of another embodiment of the drilling system with multiple artificial porosity apparatuses in a wellbore according to the disclosure.

FIG. 7 shows a diagram of another downhole production system 700 having an artificial porosity apparatus 100 disposed in the wellbore 20 in the formation 30 and configured to allow from oil and gas to flow to the surface 40 while reducing the amount of water flowing to the surface 40. The components of the system 700 are the same as the system 10; however, instead of the apparatus 100 terminating with either an end cap 270 or an incomplete bore 310, a second apparatus 710 is disposed below the apparatus 100 in the wellbore 20. The second apparatus 710 is in fluid communication with the apparatus 100 through a tubular extension 720, such as a coupling between the threaded sections 220 or a portion of tubular. The second apparatus 710 may terminate either with an incomplete bore or, as shown, with the end cap 270. With the second apparatus 710 in fluid communication with the apparatus 100, the amount of flow from the wellbore 20 into the well tubing string 50 may be increased. In some embodiments, additional apparatuses 100 may be added in series above the second apparatus 710.

Figure 8:
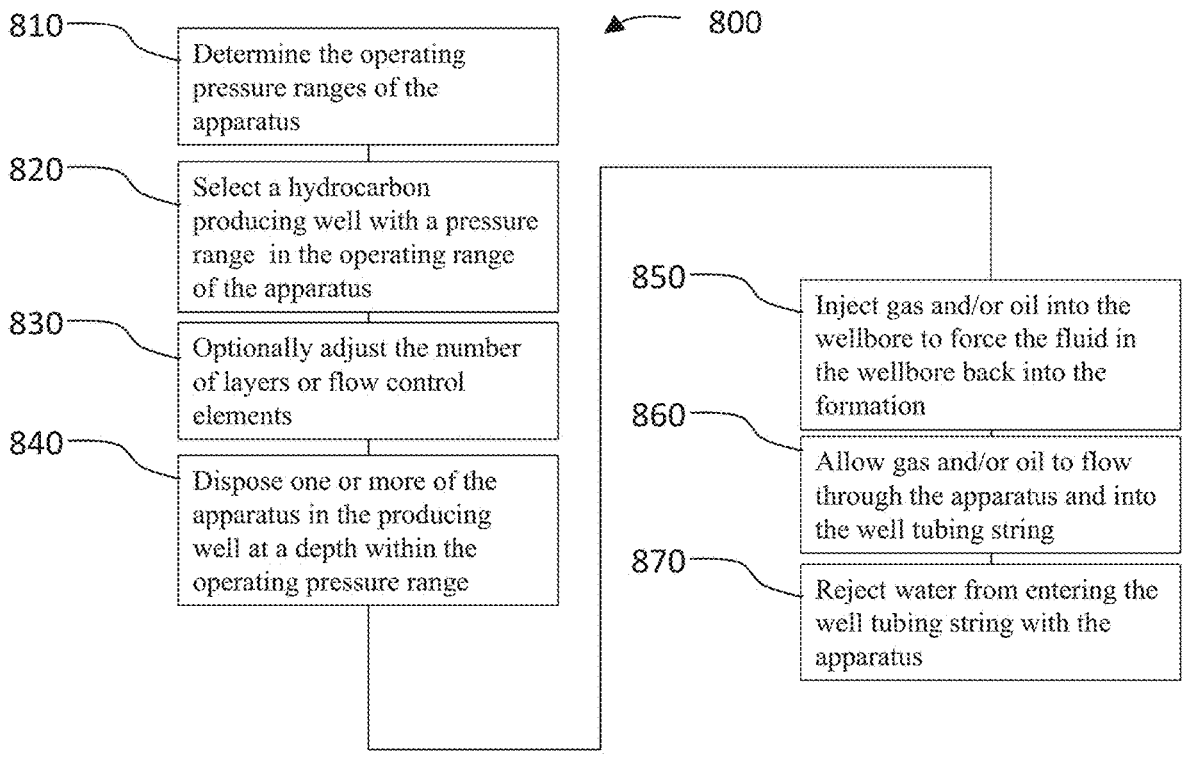
FIG. 8 is a flow chart of a method of using the apparatus to remove water from an oil and gas stream according to the present disclosure.

FIG. 8 shows a flow chart of a method 800 for producing gas or gas/oil while reducing water production using the apparatus 100. In step 810, the apparatus 100 is tested over a range of pressures to determine the low, intermediate, and high pressure ranges, wherein the intermediate range is the pressure where the apparatus 100 will allow the passage of the gas 120 or the oil 110 and the gas 120, as desired, but mostly or completely reject the passage of water 130. In step 820, a well is selected where the apparatus 100 may be disposed at a depth within the intermediate pressure range. Well selection may include evaluation of well. Evaluation of the well may include measuring or estimating the hydrostatic head or pressures at various depths within the wellbore 20. In step 830, optionally, the number of layers 340 or flow control elements per layer 340 may be adjusted to optimize the flow characteristics of the apparatus for the selected well. In step 840, one or more of the apparatus 100 may be disposed within the wellbore 20 along the well tubing string 50 below the annular sealing device 60. If the well tubing string 50 terminates at the annular sealing device 60, then the apparatus 100 may be directly attached to the bottom of the annular sealing device 60. The apparatuses 100 may be installed in series or parallel. In step 850, gas and/or oil may be injected from the surface 40 to displace fluid in the wellbore 20 back into the formation 30. In some embodiments, step 850 is optional. In step 860, the gas/the gas and the oil flow through the channels 320 into the openings 350 and into the central bore 310 and up the well tubing string 50. In step 870, the water flows through the wellbore 20 and back into the formation 20.

For example, it may be determined that one embodiment of the apparatus 100, when tested over a range of pressures in step 810, is determined to have a low pressure range that is below 100 psig (690 kPa), a intermediate pressure range for gas is 100 to 800 psig (690 kPa to 5.52 MPa), a intermediate range for oil is 200 to 800 psig (1.38 MPa to 5.52 MPa), and a high pressure range is above 800 psig (5.52 MPa). A well may be selected where the apparatus 100 may be installed where the pressure in the wellbore 20 is 500 psig (3.45 MPa), which falls in the intermediate pressure ranges of both oil and gas. Once the well is selected, apparatus 100 may be installed in the wellbore 20. From that point, oil and gas will flow across the barriers presented by the wire screen 230, the bars 330 (or the rods 430), and through the openings 350 and into the central bore 310 from transport up the well tubing string 50. The water 130, which is unable to pass through all of the barriers, will be rejected back into the wellbore 30 and possibly back into the formation 20 through the perforations 80.

In some embodiments, a single apparatus 100 may be installed in step 840 and may include the end cap 270 on its lower end. In some embodiments, where step 840 may include installing more than one apparatus 100, an end cap 270 may be included on each separate series formed by the arrangement of the apparatuses 100 on the lower end of the lower or lowest of the apparatuses 100 of each series.

All of the apparatuses and methods disclosed and claimed herein can be made and executed without undue experimentation in light of the present disclosure. While the methods and apparatus of this invention have been described in terms of preferred embodiments, it will be apparent to those of skill in the art that variations may be applied to the methods, processes and/or apparatus and in the steps or in the sequence of steps of the methods described herein without departing from the concept and scope of the invention. More specifically, it will be apparent that certain features which are both mechanically and functionally related can be substituted for the features described herein while the same or similar results would be achieved. All such similar substitutes and modifications apparent to those skilled in the art are deemed to be within the scope and concept of the invention.

While embodiments in the present disclosure have been described in some detail, according to the preferred embodiments illustrated above, it is not meant to be limiting to modifications such as would be obvious to those skilled in the art.

The foregoing disclosure and description of the disclosure are illustrative and explanatory thereof, and various changes in the details of the illustrated apparatus and system, and the construction and the method of operation may be made without departing from the spirit of the disclosure.

What is claimed is:

1. An oil-field apparatus comprising:

a cylindrical member with a central bore and a plurality of channels cut into an outer surface of the cylindrical member;

a plurality of openings at the bottom of each of the plurality of channels, where each of the openings extends to the central bore;

a plurality of elements disposed in each of the plurality of channels, wherein each of the plurality of elements has a length substantially the same as a length of its respective channel, wherein each of the plurality of elements is a cylindrical rod made of steel or stainless steel, and wherein the plurality of elements is arranged in at least two layers and fitted together to form a gas tight seal at normal atmospheric pressure; and a fastening means at each end of each of the plurality of elements to attach the plurality of elements to the cylindrical member;

wherein the apparatus is suitable for disposition in a wellbore in a formation; and wherein (1) each of the cylindrical rods of the plurality of elements has a diameter, and the diameters of the cylindrical rods are non-uniform, (2) at least of the cylindrical rods of the plurality of elements is tubular, or both.

2. The apparatus of claim 1, wherein each of the openings is cross shaped.

3. The apparatus of claim 1, wherein the plurality of elements is arranged in at least four layers.

4. The apparatus of claim 1, further comprising:

an end cap disposed on one end of the cylindrical member to close the central bore.

5. The apparatus of claim 1, wherein the central bore extends fully through the cylindrical member.

6. The apparatus of claim 1, further comprising:

a wire screen wrapped around a circumference of the cylindrical member and covering the plurality of channels.

7. A system for producing oil and/or gas from in a wellbore in a formation, comprising:

a well tubing string disposed in the wellbore;

an annular sealing device disposed in the wellbore and attached to the well tubing string;

an apparatus disposed on the well tubing string and below the annular sealing device the apparatus comprising:

a cylindrical member with a central bore and a plurality of channels cut into an outer surface of the cylindrical member;

a plurality of openings at the bottom of each of the plurality of channels, where each of the openings extends to the central bore;

a plurality of elements disposed in each of the plurality of channels, wherein each of the plurality of elements has a length substantially the same as a length of its respective channel, wherein each of the plurality of elements is a cylindrical rod made of steel or stainless steel, wherein the plurality of elements is arranged in at least two layers and fitted together to form a gas tight seal at normal atmospheric pressure;

wherein (1) each of the cylindrical rods of the plurality of elements has a diameter, and the diameters of the cylindrical rods are non-uniform, (2) at least of the cylindrical rods of the plurality of elements is tubular, or both; and a fastening means at each end of each of the plurality of elements to attach the plurality of elements to the cylindrical member.

8. The system of claim 7, further comprising an end cap disposed on a bottom end of the cylindrical member.

9. The system of claim 7, further comprising:

a second apparatus disposed below and coupled in series with the apparatus; and an end cap disposed on a bottom of the second apparatus.

10. A method for producing gas and/or oil from a wellbore in a formation, the method comprising:

flowing gas and/or oil from the wellbore through an apparatus connected to a tubing string disposed in the wellbore in an operating pressure range of the apparatus, where the apparatus comprises:

a cylindrical member with a central bore and a plurality of channels cut into an outer surface of the cylindrical member;

a plurality of openings at the bottom of each of the plurality of channels, where each of the openings extends to the central bore;

a plurality of elements disposed in each of the plurality of channels, wherein each of the plurality of elements has a length substantially the same as a length of its respective channel, wherein each of the plurality of elements is a cylindrical rod made of steel or stainless steel, and wherein the plurality of elements is arranged in at least two layers and fitted together to form a gas tight seal at normal atmospheric pressure;

wherein (1) each of the cylindrical rods of the plurality of elements has a diameter, and the diameters of the cylindrical rods are non-uniform, (2) at least of the cylindrical rods of the plurality of elements is tubular, or both;

a fastening means at each end of each of the plurality of elements to attach the plurality of elements to the cylindrical member; and rejecting the flow of water through the apparatus to the well tubing string.

11. The method of claim 10, further comprising:

estimating an operating pressure range of the apparatus.

12. The method of claim 10, further comprising:

configuring the apparatus based on the operating pressure range of the wellbore.

13. The method of claim 10, further comprising:

installing the apparatus in the wellbore.

14. The method of claim 10, further comprising:

injecting gas and/or oil into the wellbore prior to flowing gas and/or oil to the surface.

* * * * *